US006173541B1

(12) United States Patent
Petta

(10) Patent No.: US 6,173,541 B1
(45) **Date of Patent: *Jan. 16, 2001**

(54) WINDOW ASSEMBLY

(75) Inventor: Gabriel Petta, Woodbridge (CA)

(73) Assignee: Alpa Lumber Inc., Mississauga (CA)

( * ) Notice: Under 35 U.S.C. 154(b), the term of this patent shall be extended for 0 days.

This patent is subject to a terminal disclaimer.

(21) Appl. No.: 09/437,096

(22) Filed: Nov. 9, 1999

Related U.S. Application Data

(63) Continuation of application No. 08/947,904, filed on Oct. 9, 1997, now Pat. No. 5,987,826.

(51) Int. Cl.[7] ..... E06B 1/24

(52) U.S. Cl. ..... 52/204.5; 52/208; 52/204.53; 52/204.55; 52/204.71

(58) Field of Search ..... 52/204.5, 208, 52/204.53, 204.591, 204.593, 204.62, 204.71, 213, 214

(56) References Cited

U.S. PATENT DOCUMENTS

| | | | | |
|---|---|---|---|---|
| 1,543,334 | | 6/1925 | Loeb . | |
| 2,776,737 | * | 1/1957 | Bianco | 52/213 |
| 3,090,085 | * | 5/1963 | Brown | 52/204.591 |
| 3,208,564 | * | 9/1965 | Sitterly | 52/213 |
| 3,336,698 | | 8/1967 | MacGregor . | |
| 3,451,168 | | 6/1969 | Pengelly . | |
| 3,491,486 | | 1/1970 | Caruth . | |
| 4,604,840 | * | 8/1986 | Mondon | 52/204.593 |
| 4,742,647 | | 5/1988 | Pacca . | |
| 4,754,592 | * | 7/1988 | Moench | 52/204.593 |
| 4,809,469 | * | 3/1989 | Klein | 52/213 |
| 4,890,418 | | 1/1990 | Sachs . | |
| 4,996,814 | * | 3/1991 | Guillemet | 52/208 |
| 5,315,798 | | 5/1994 | Zarwell . | |
| 5,355,626 | | 10/1994 | Sachs . | |
| 5,555,684 | | 9/1996 | Galowitz et al. . | |
| 5,687,519 | * | 11/1997 | Bruchu | 52/213 |

FOREIGN PATENT DOCUMENTS

| | | | |
|---|---|---|---|
| 2252586 | 8/1992 | (GB) | 52/208 |
| 93/11332 | 6/1993 | (WO) | 52/208 |

* cited by examiner

*Primary Examiner*—Carl D. Friedman
*Assistant Examiner*—Phi Dieu Tran A
(74) *Attorney, Agent, or Firm*—Bereskin & Parr

(57) ABSTRACT

A snap fitted dual frame window assembly provides for convenient installation of a window in a basement foundation of a residential home. An outer frame is used as a form or spacer for the window during pouring of a concrete foundation wall and has a sloping recessed guiding wall to accommodate an inner vinyl frame. Vinyl frame clips are attached to the inside of the outer frame to secure the inner vinyl frame. The inner vinyl frame includes a channel section which can be forced over the frame clips and then is held, in a snap fit, by the frame clips. One arm of a hinged window sash is mounted on the inner frame and the other is mounted on a window frame. The inner frame can be easily removed from the outer frame and re-installed in different orientations.

12 Claims, 7 Drawing Sheets

WINDOW ASSEMBLY

This application is a continuation application of application no. Ser. No. 08/947,904, filed on Oct. 9, 1997 now U.S. Pat. No. 5,987,826.

FIELD OF THE INVENTION

The present invention relates generally to windows, and more particularly to a window assembly and a method for installing the window assembly.

BACKGROUND OF THE INVENTION

Many homes in northern climates have poured concrete basements. As part of the construction process, forms are generally installed to guide concrete around various objects such as window and door frames so that the concrete forms a desired building foundation structure. After forms are installed, but prior to pouring the concrete, a basement window frame with glass or a complete window frame is typically installed into them. The concrete is then poured around the window frame, after which the forms are removed, leaving the window in place.

During the subsequent construction of the home, materials such as gravel for the basement floor, concrete to pour the basement floor, pipes and the like are generally passed through the basement window, which commonly causes undesirable damage to the window frame. Additionally, the glass of the window is also commonly damaged. It is known that such activity causes many problems, such as damaged, broken or cracked frame mouldings and window breakage. Such damage then necessitates costly and time consuming re-installation of the window assembly.

It is therefore desirable to develop a window which may be installed after such construction activities have been completed. There have been previous attempts to develop such a window, but without success.

U.S. Pat. No. 3,336,698 to MacGregor discloses a combination window assembly having a frame, a screen and a storm window. The assembly utilizes extruded metal or hard extruded plastic window track guides. However, these components are still subject to damage from further construction activity, since they must be in place during the initial construction process. Even if the window track guides are only damaged to a slight degree, the workings of the complete assembly will be adversely affected, due to the precise nature of the dimension and orientation requirements of the assembly components.

U.S. Pat. No. 4,742,647 to Pacca discloses a window construction for a double glazed window which incorporates interlocking mouldings and slot portions which facilitate installation and de-installation of window frames and casings. However, substantial time and effort is still required to install and remove the complete window assembly. Such involved installation processes result in the tendency of builders to leave the frame alone in the foundation wall and the window pane uninstalled, during the period of continued construction. Since construction activities can continue for days or weeks, this activity can result in significant site safety and security dangers. Additionally, the frame is exposed during this time, thereby increasing the risk of damage.

U.S. Pat. No. 4,890,418 to Sachs describes an improved access panel assembly where the assembly can be rotated 180°. However, this assembly does not allow convenient and interchangeable installation of window pane with various opening orientations within the window frame.

Accordingly, there is a need for a window assembly whose installation can be conveniently integrated into the conventional construction of a basement foundation, which protects the window from damage, and which allows a user to variously choose the orientation and opening characteristics of the window being installed. Further, there is a need for a window assembly which may easily and conveniently be installed and removed from its opening.

SUMMARY OF THE INVENTION

In one aspect, the present invention is directed to a window assembly comprising an outer frame, a plurality of frame clips, inner frame, and a window frame. The outer frame has a front surface and an inner surface with a guiding wall. Each frame clip has an inner surface and an outer surface, with the outer surface being permanently attachable to the sloped recessed wall of the inner surface of the outer frame. The inner frame has an outside surface which engages with the inside surface of the frame clips and a first set of grooved sections suited to support the stationary arms of a pair of window sashes. The window frame holds a glass pane and has a second set of grooved sections suited to support the movable arms of the pair of window sashes, such that the window frame is rotatably connected to the inner frame by the pair of window sashes. Alternatively, the inner frame may be fixed to the window frame, thereby eliminating the need for the sashes.

The window assembly allows easy installation and removal of fragile components, thereby preventing damage during construction. Additionally, the window may be removed only from the interior of the building, thereby providing security.

BRIEF DESCRIPTION OF THE DRAWINGS

These and other features and advantages of the present invention will be more fully and completely understood, when the following detailed description is read in connection with the attached drawings, in which.

DETAILED DESCRIPTION OF THE PREFERRED EMBODIMENT

Figure 1:
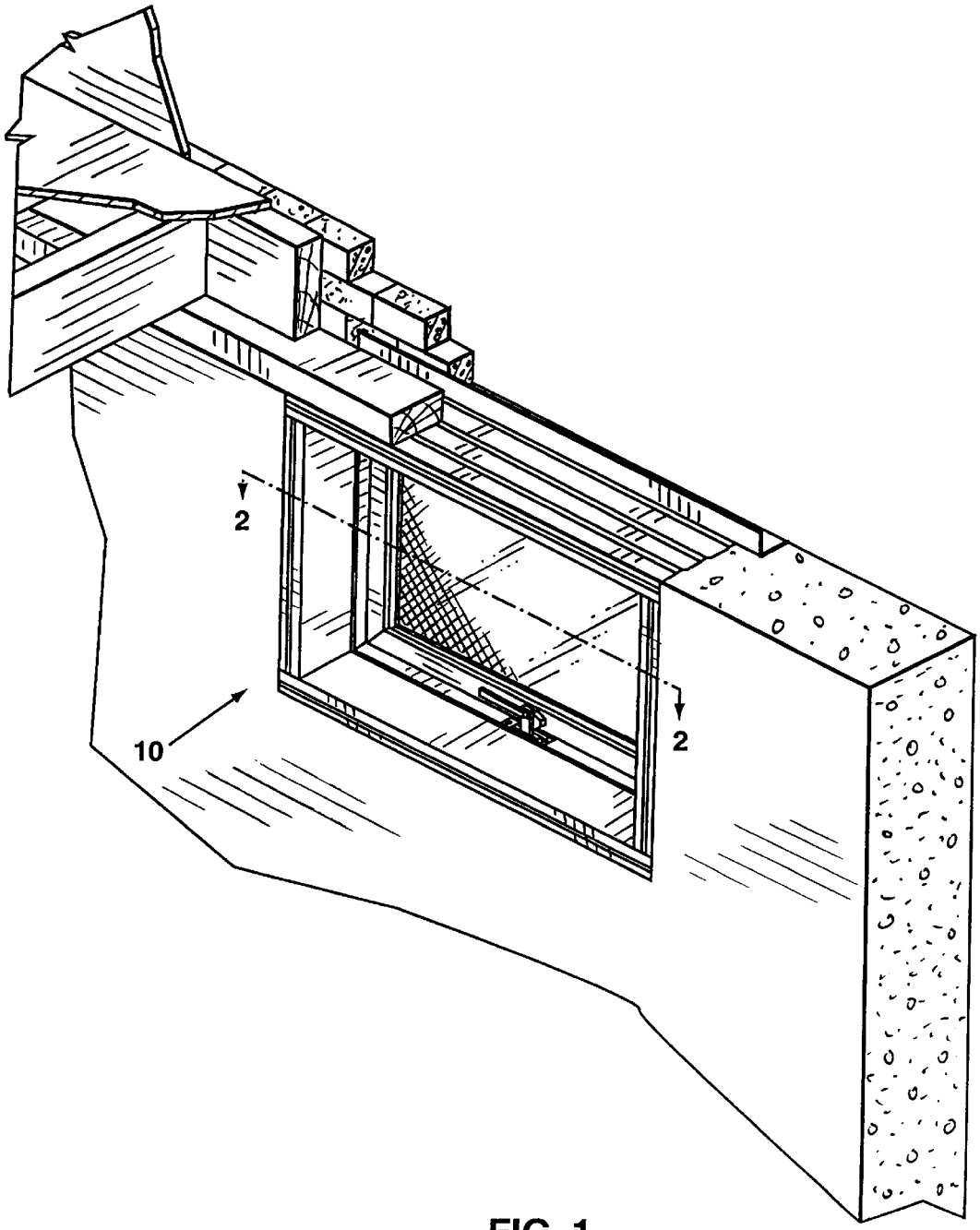
FIG. 1 is a perspective view of a window assembly made in accordance with a preferred embodiment of the present invention.
Figure 2:
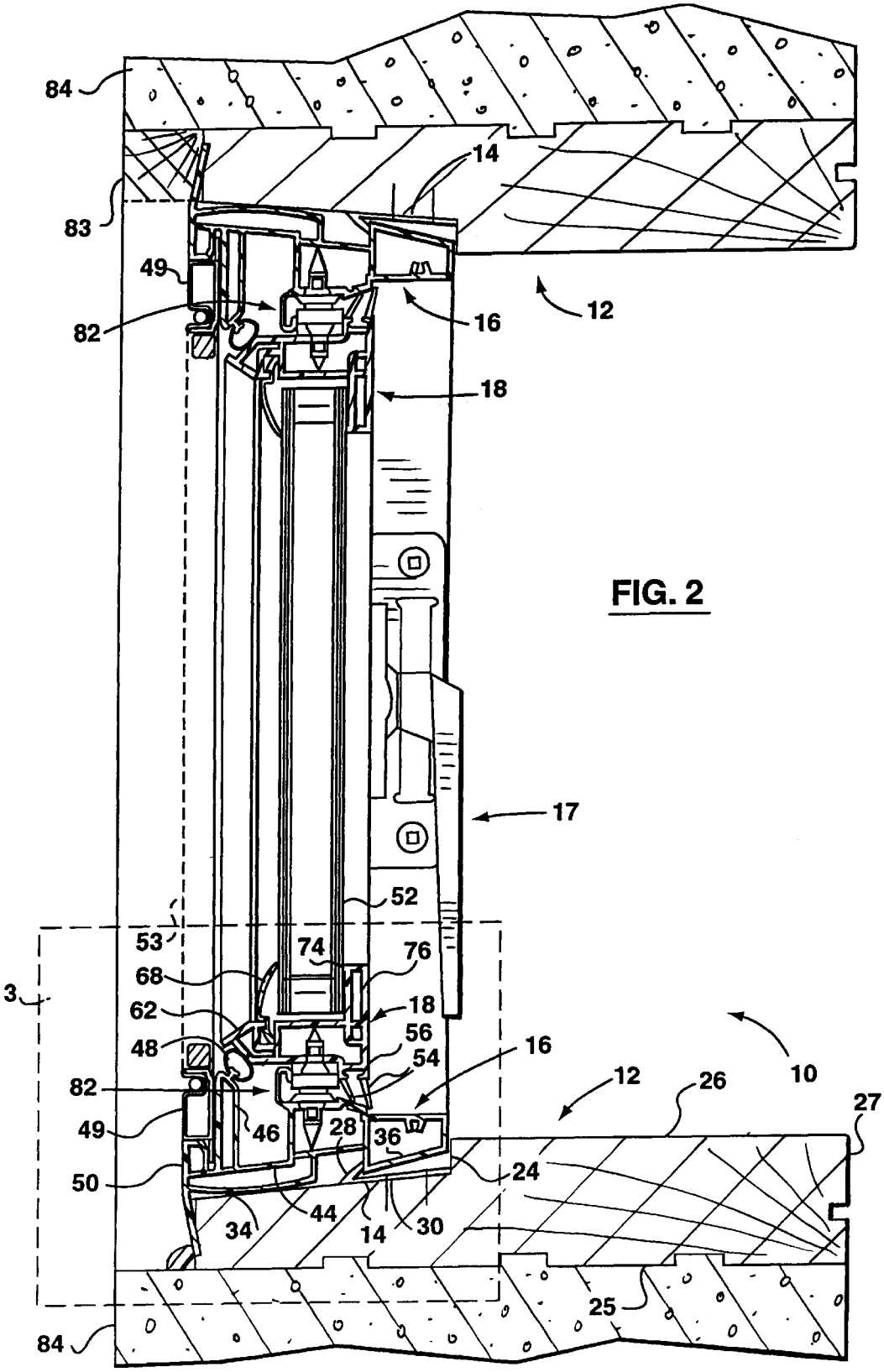
FIG. 2 is a cross-sectional view of the window assembly, taken along the line 2—2 in FIG. 1.

Referring to FIG. 1, illustrated therein is a window assembly 10 made in accordance with a preferred embodiment of the present invention. Referring now to FIGS. 1 and 2, the window assembly 10 comprises an outer frame 12, a frame clip 14, an inner frame 16, and a window frame 18. In the preferred embodiment, the outer frame 12 is made from wood and the frame clip 14, the inner frame 16, and the window frame 18, are all fabricated from an extrusion of resilient plastic material, a suitable example of which is polyvinyl chloride (PVC). Of course it will be appreciated that these parts may be made from any suitable material, such as wood, plastic, or metal.

Figure 3:
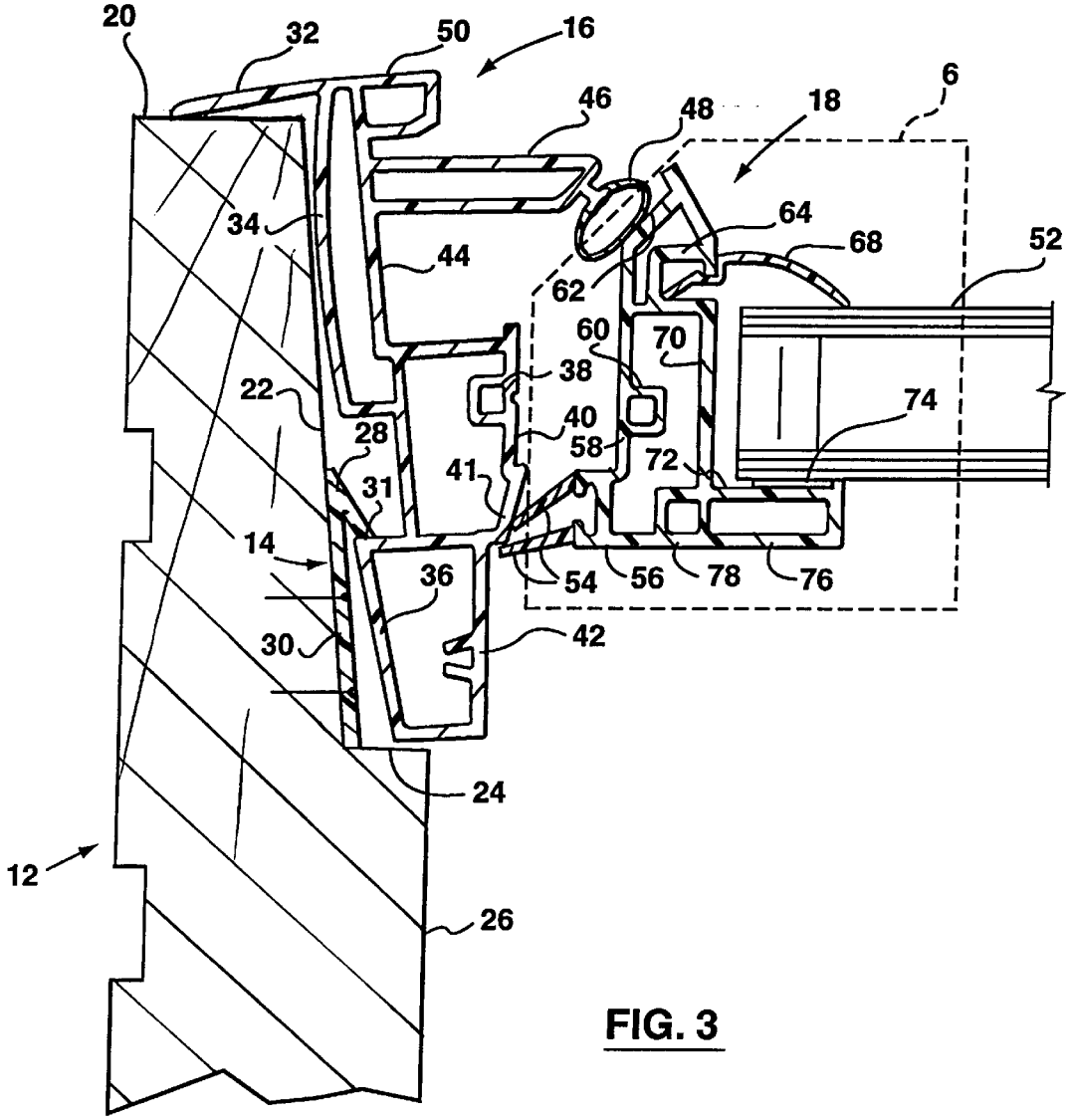
FIG. 3 is an enlarged view of area 3 from FIG. 2.

Referring now to FIGS. 2 and 3, the outer frame 12 has an exterior surface 20, an inner surface 26, a guiding wall 22, an abutment wall 24, an interior surface 27 and an outer surface 25. A slight obtuse angle is preferably formed between the front surface 20 and the guiding wall 22 such that the guiding wall 22 and the abutment wall 24 are suited to receive, guide, and hold the inner frame 16. As will be readily understood, the outer frame 12 is formed from four walls, so as to surround the remainder of the window assembly 10 (not shown).

While it is preferable that the guiding wall 22, and abutment wall 24 be present on all four sides of the outer frame 12, these features are simply an aid to easily mounting the inner frame 16 within the outer frame 12.

As will be appreciated, the size of the opening formed by the outer frame 12 is such that it will receive the inner frame therein, with the outer and inner frames preferably forming a friction fit. The clip 14 is provided to secure the inner frame within the opening defined by the outer frame. The clip 14 may be of any suitable design, and in the preferred embodiment has a dovetail section 28 and a connector section 30 so that the clip forms the general shape of barb. The dovetail section 28 forms an acute angle such that when force is applied to the free end 31 of the dovetail section 28, it tends to deform towards the connector section 30. The connector section 30 is preferably secured to the guiding wall 22 of outer frame 12, such that the connector section 30 approximately abuts the abutment wall 24. As will be later discussed, the free end 31 of the clip 14 locks the inner frame 16 into the opening of the outer frame 12 when the inner frame 16 is inserted into the opening of the outer frame 12.

Figure 4:
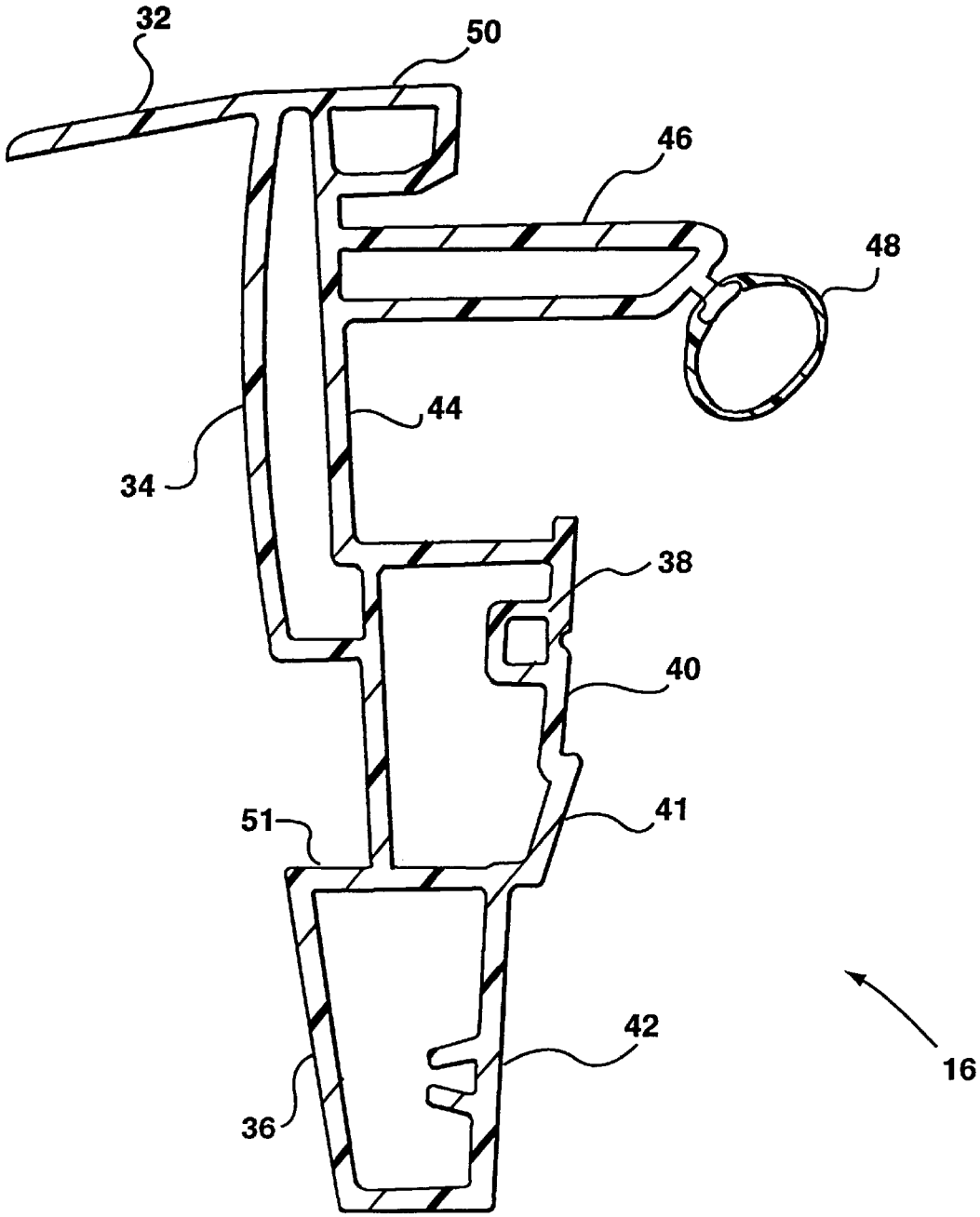
FIG. 4 is a cross-sectional view of an inner frame of the window assembly shown in FIG. 1.

Referring to FIG. 4, the inner frame 16 has a flange 32, a flexible member 34, a locking portion 36, a screw channel 38, a sash support section 40, a weather stripping contact section 41, a screw channel 42, a rigid member 44, a weather stripping support arm 46, weather stripping 48, and a screen support member 50.

The flange 32 is provided on the inner frame 16 such that when the flange 32 is placed over the front surface 20 of the outer frame 12, a protective barrier is formed between the outer frame 12 and the inner frame 16. This prevents water and other environmental agents from leaking into the window assembly 10. As shown in FIG. 4, the flange 32 may be angled slightly to ensure a good seal between the front surface 20 of the outer frame 12 and the inner frame 16.

The surface of the flexible member 34 is slightly bowed, so that when pressure is perpendicularly applied, the flexible member 34 slightly deforms towards the rigid member 44. This allows the inner frame 16 to fit snugly within the outer frame 12 and frictionally engage the guiding wall 22.

The locking portion 36 is a rigid structure designed for engagement with the dovetail section 28 of the frame clip 14. The locking portion 36 is sloped in the same direction as the dovetail section 28 of the clip 14. This allows easy insertion of the inner frame 16 so that the locking portion 36 may be moved past the dovetail section 28. As this occurs, the dovetail section 28 is compressed, until the locking portion 36 passes the dovetail section 28, when the dovetail section 28 expands and engages the abutment surface 51 on the locking portion 36.

Figure 7:
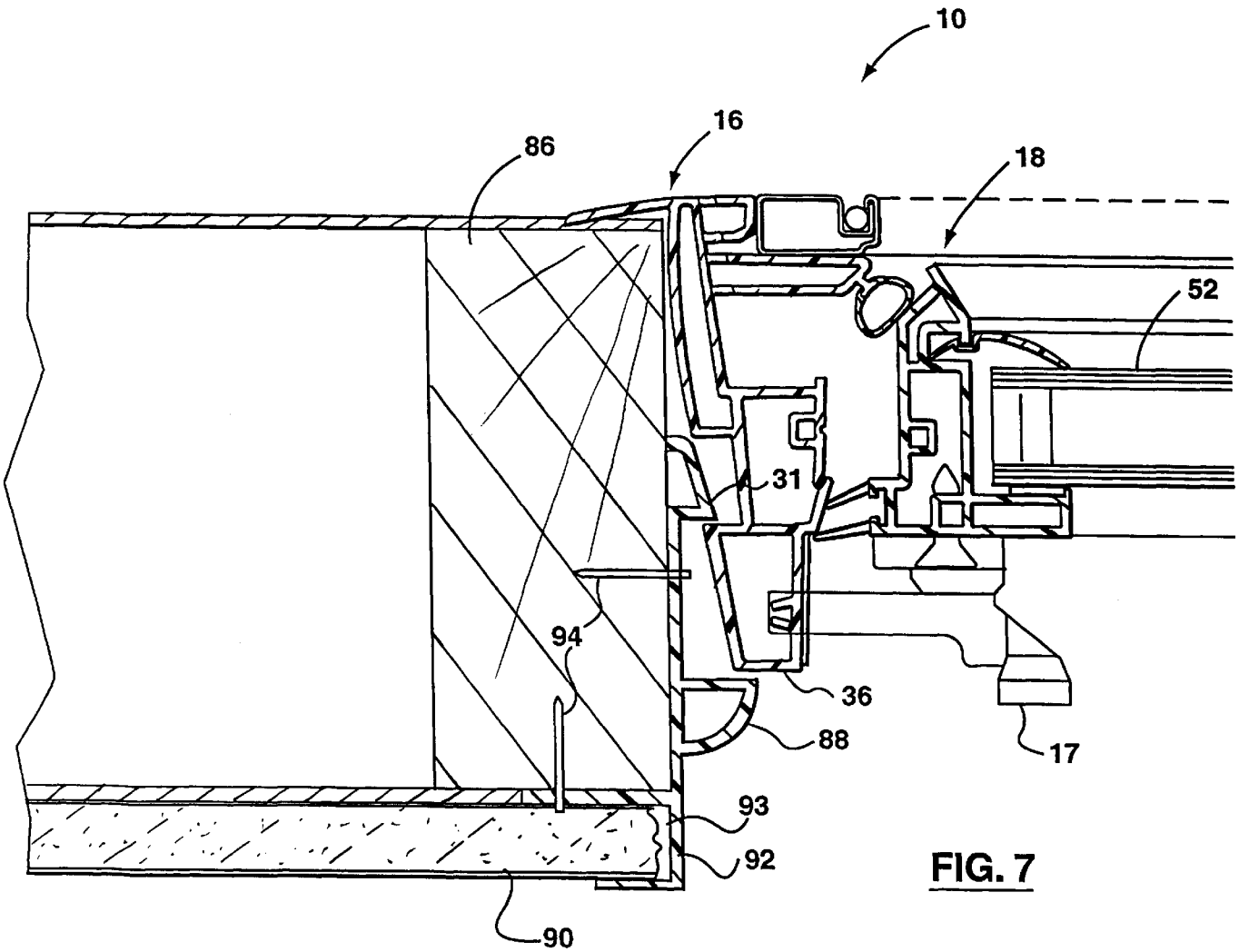
FIG. 7 is a cross-sectional view taken along the line 2—2 in FIG. 1, and having an alternative outer frame member.

The sash support section 40 is sized to support a stationary arm of a window sash as will be readily appreciated (not shown). The stationary arm can be secured to the inner frame 16, by inserting a screw through the stationary arm and into the screw channel 38. The screw channel 38 may be of any suitable shape, but in the preferred embodiment, has a square channel dimensioned to hold an installed screw in a secure manner. The screw channel 42 allows for the installation of a window locking port suitable for receiving a lock mechanism (FIG. 7).

The weather stripping support arm 46 extends from the inner frame 16 and supports weather stripping 48. The weather stripping 48 is provided to form a seal between the inner frame 16 and the window frame 18. The weather stripping 48 is preferably formed of materials which conform to industrial code standards, namely A3B3 for air/water and A2B2 for homes. The screen support member 50 is provided to support a screen adaptive mechanism 49 to hold a screen 53 as will be understood by a skilled person.

Figure 5:
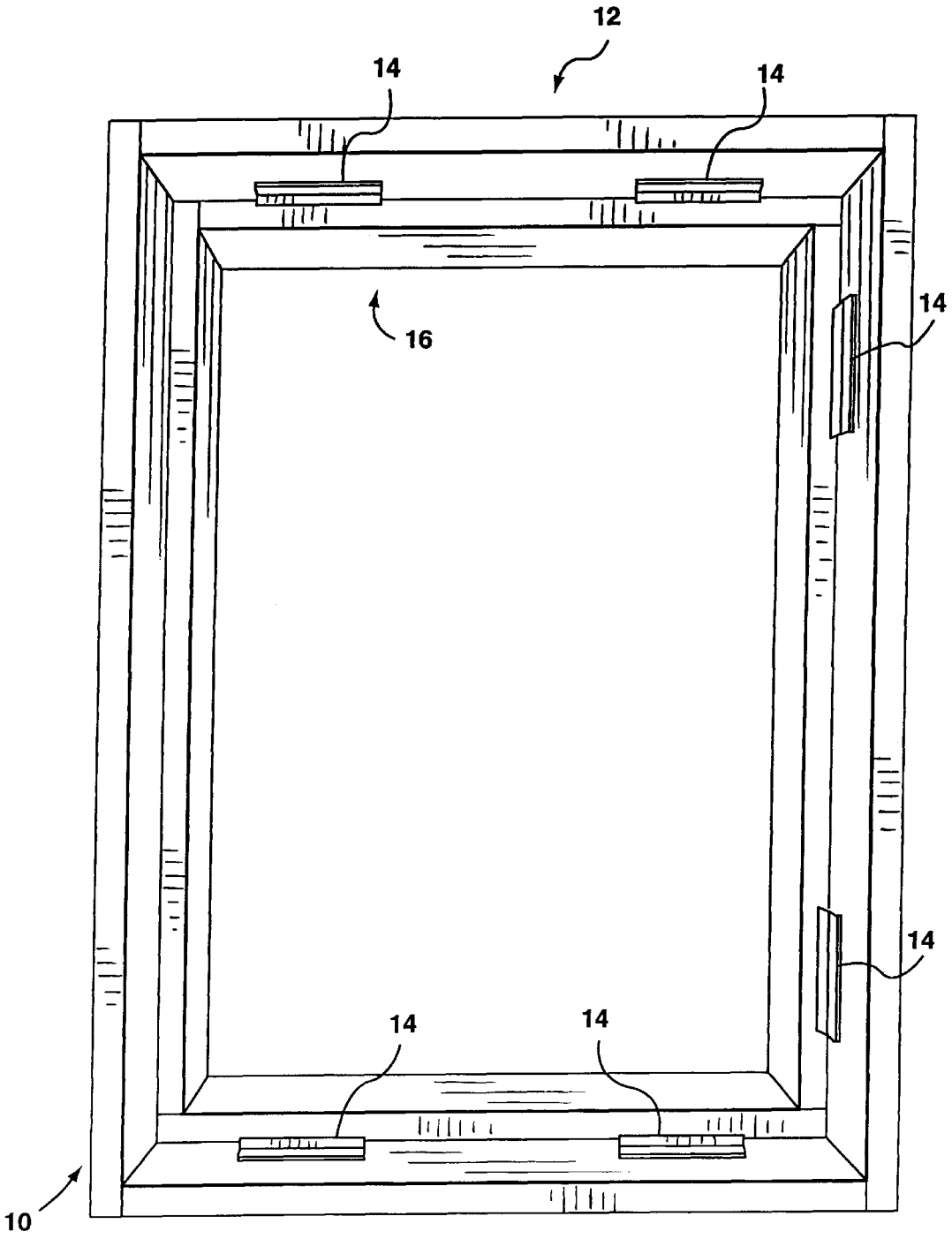
FIG. 5 is a perspective view of an inner frame and an outer frame of the window assembly shown in FIG. 1.

Referring to FIGS. 2, 3, and 5, the inner frame 16 can be snapfitted into the outer frame 12 as follows. Since the guiding wall 22 of the outer frame 12 is tapered with a wider opening at the front surface 20, when force is exerted against the inner frame 16, the guiding wall 22 guides the inner frame 16 into the outer frame 12. As the inner frame 16 is guided into the outer frame 12, the flexible member 34 is depressed increasingly towards the rigid member 44. This ensures a snug friction fit between the outer frame 12 and the inner frame 16. FIG. 5 provides a view from the interior side of the window assembly showing an example configuration of a plurality of frame clips 14. As the locking portion 36 passes the dovetail section 28 of frame clips 14, the free end of dovetail section 28 is deformed towards the connector section 30.

As the locking portion 36 nears abutment wall 24, the locking portion 36 snaps into dovetail section 28 with the free end 31 of the dovetail section 28 returning to its original orientation with respect to connector section 30. During this operation, the flange 32 of the inner frame 16 exerts force against the front surface 20 of the outer frame 12 which results in a corresponding exertion of force by the abutment surface 51 on the locking portion 36, on the dovetail section 28. Once the inner frame 16 is fitted into the frame clip 14, the flange 32 remains biased against the front surface 20 of the outer frame 12 and the locking portion 36 continues to exert a corresponding force on the tip of the free end 31 of the dovetail section 28. As a result, the inner frame 16 is securely engaged with the outer frame 12 by the frame clip 14. Further, the flange 32 forms a seal with the front surface 20 to prevent leakage of various environmental agents into the window assembly 10 apparatus.

Figure 6:
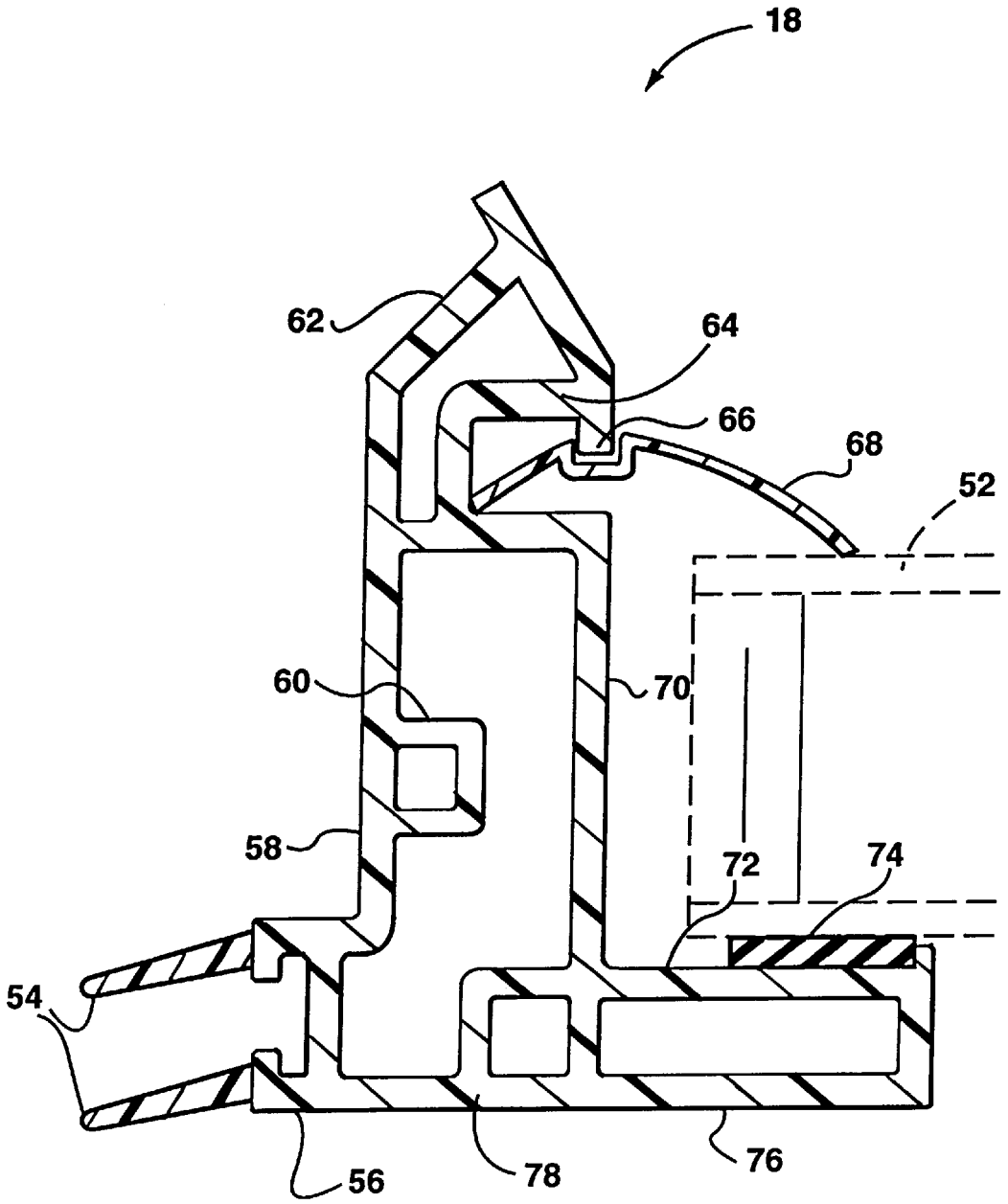
FIG. 6 is an enlarged view of area 6 from FIG. 3.

Now referring to FIGS. 2, 3, and 6, the window frame 18 is suited for holding a glass window pane 52, and comprises one or more weather stripping fins 54, weather stripping support arms 56, a sash support section 58, a screw channel 60, an outer flexible member 62, an inner flexible member 64, a flexible end 66, a glass stop 68, an inner member 70, a cushioning member 72, a cushioning pad 74, an outer member 76, and a screw channel 78.

The weather stripping fins 54 extend from the front of the weather stripping arm 56, and are formed of materials which conform to industrial code standards, namely A3B3 for air/water and A2B2 for homes. The sash support section 58 is sized to support the movable arm of a window sash (not shown) and this arm may be secured to the inner frame 16 by screwing a screw through the moveable arm and into the screw channel 60. The screw channel 60 has a square channel dimension such that its double PVC wall securely holds an installed screw. The outer flexible member 62 and inner flexible member 64 preferably comprise PVC which are connected in an angular fashion so as to provide for flexible movement.

When force is applied to the outer flexible member 62, the outer flexible member 62 and the inner flexible member 64 deform to cause the flexible end 66 to rotate inwardly and exert force on the glass stop 68, which in turn exerts a securing force on the window pane 52. During the application of force, the sash support section 58, inner member 70, cushioning member 72, and outer member 76 maintain their rigid form. The cushioning pad 74 is coupled to the cushioning member 72, and the window pane 52 is attached to the cushioning pad 74 using industrial adhesive agents.

Referring again to FIGS. 2 and 3, the window frame 18 may be operably connected with the inner frame 16 as follows. The window frame 18 is attached to the inner frame 16 by at least one hinged window sash 82, with the inner frame 16 being coupled to the stationary arm of the hinged window sash 82, and the window frame 18 being coupled to the moveable arm of the hinged window sash 82. In some cases it may be desirable to provide a pair of hinged window sashes 82, one on each side of the window assembly (as seen in FIG. 2). The inner frame 16 and the window frame 18 are dimensioned such that when the hinged window sashes 82 are "closed", the weather stripping support arm 46 is positioned over the outer flexible member 62 such that such that the weather stripping 48 makes air-tight contact with the outer flexible member 62, and the weather stripping support arm 56 is positioned over the stripping contact section 41 such that weather stripping fins 54 make air-tight contact with stripping contact section 41.

In use, the user may assemble the window assembly 10 by first installing the outer frame 12 into a basement foundation when the foundation is being formed. A removable wood block 83 is positioned in front of front surface 20 and is used to space the wood frame from the edge of the form during concrete pouring as is commonly known. Once the concrete has been poured and has dried, the wood block is removed, allowing front surface 20 to be free of concrete and positioned back from the front edge of the solidified concrete wall.

The user may then appropriately attach the frame clips 14 to the outer frame 12 using nails, screws, staples, industrial strength glue or other attachment hardware. Alternatively, the frame clips 14 may be installed prior to installation of the outer frame. The user may then position and guide the inner frame 16 which is attached to the window frame 18 by the hinged window sashes 82 into the outer frame 12, as previously discussed.

The window assembly 10 vastly simplifies the installation of windows in the basement of a residential home, allowing a user to install the window assembly 10 without special tools. Once the outer frame 12 is established within a basement foundation position, the user simply snaps the inner frame 16 into the outer frame 12 to complete the installation of window assembly 10. This can be done, for example, during the final stages of construction, thereby minimizing risk of damage to the window.

Additionally, if the glass pane 52 breaks or if it is desirable to remove the window from the outer frame 12, the inner frame 16 may be conveniently disengaged from the outer frame 12, by snapping out the pertinent inside mouldings of the inner frame 16. The user can use a screwdriver or other prying tool to remove the inner frame 16 from the outer frame 12, by prying the locking portion 36 inwardly, causing the locking portion 36 to become disengaged from the frame clip 14. However, it will be appreciated that the window may be removed in this fashion only from the interior of the house. Accordingly, the window assembly 10 provides the user with critical home safety and security features. Firstly, since the user may only remove the inner frame 16 from the outer frame 12 from the inside of a home, basic window security is provided. Additionally, since the inner frame 16 may be easily engaged and disengaged from the outer frame 12, it is possible for builders to use the open window for construction activity during the day and then to effectively lock the windows in the evening by the reinstalling inner frame 16 and the window frame 18 into the outer frame 12.

Continued construction activity through the installed outer frame 12, may result in damage to the inner surfaces or outer edges of the outer frame 12 and the frame clip 14. However, such damage will generally not affect the later installation of the remainder of the window assembly 10. If the inner surface or outer edges of the outer frame 12 are damaged, the user will still be able to install the inner frame 16 into outer frame 12 since the inner frame 16 will still fit into the outer frame 12 and will cover any damaged inner surfaces or edges. If the frame clip 14 is damaged, the user may easily replace it. However, none of the operational components of the window assembly will be damaged.

Additionally, the window assembly 10 allows the user to conveniently install the inner frame 16 and adjoining window frame 18 within the outer frame 12 in various orientations. The user has the option of installing inner frame 16 and window frame 18 in a right side up or upside down manner. If the outer frame 12, frame clip 14 and inner frame 16 are symmetrical around their respective horizontal axis, it is possible for the user to install the inner frame 16 either in a right side up or upside down manner. Accordingly, the user may configure the window pane 52 to open inwardly from the top of the window or from the bottom of the window. It will also be appreciated that, simply by reorienting the window components, that the window may be opened from the left or the right.

In summary, the present invention allows for convenient installation of a window assembly even where the outer frame 12 is damage from continued construction activity. The installation of window assembly has additionally been vastly simplified so that a user may easily install the complete window assembly without special tools. Once the outer frame 12 is established within a basement foundation position, a user is only required to snap the inner frame 16 into the outer frame 12 until the inner frame 16 is securely engaged. If the window pane 52 breaks, or if the user desires to remove the window for any reason, the inner frame 16 may be easily removed from the outer frame 12 through the use of a prying tool. This feature also provides the user with important home safety and security features due to the fact that all components of the window assembly 10 are removable only from the inside of the building. Additionally, the user has the option of installing the inner frame 16 either in an upright or upside down fashion due to the horizontal symmetry of outer frame 12, frame clip 14, and inner frame 16.

As shown in FIG. 7, the window assembly 10 may be further adapted for use in commercial mobile or prefabricated homes by utilizing a 2×4 stud 86 and a frame clip 88, instead of outer frame 12 and frame clip 14, to secure the locking portion 36 of the inner frame 16. The frame clip 88 has larger dimension than the frame clip 14, and is attached to the stud 86 through the use of nails, screws, staples or other mechanical hardware. The frame clip 88 has dimensions suited to guide, snap and secure the locking portion 36 within the frame clip 88. To this end, the frame clip 88 has a rear abutment portion 89, since there is no sloping wall terminating at an abutment portion in the outer frame. The frame clip 88 may be further attached to a section of drywall or finished panel 90 on the inside wall of the mobile home and include a flange 92 to aesthetically finish the trimming around the window. The flange 92 forms a slot 93 in which the drywall 90 may be inserted.

In this case, the frame clip 88 may be secured to two faces of the stud 86, for example with nails 94, prior to installing the drywall 90. When the drywall 90 is installed, it may be inserted into the slot 93 to cover the edge of the drywall.

The window assembly 10 may alternatively comprise a single window frame in place of the inner frame 16 and the window frame 18 (not shown).

As well, the window assembly 10 may alternatively comprise an outer frame 12, inner frame 16, and window frame 18 with square dimensions. Due to the resulting symmetry of these components along their respective horizontal and vertical axis, the user may install the window in four distinct orientations depending on their preference. In this way, window assembly 10 may be installed to open inwardly either from the top, bottom, left side, or right side of the inner frame 16.

As will be apparent to persons skilled in the art, various modifications and adaptations of the structure described are possible without departure from the spirit of the present invention, the scope of which is defined in the appended claims.

I claim:

1. A window assembly for an opening in a wall defining an interior space and an exterior space, comprising:

(a) an outer frame having an exterior surface, an inner surface defining a first opening having a perimeter, an interior surface and an outer surface, said inner surface including a guiding wall adjacent to said exterior surface, said guiding wall forming an obtuse angle with said exterior surface, said guiding wall extending continuously along said perimeter;

(b) an inner frame sized to fit within said first opening, said inner frame defining a second opening;

(c) a window frame for holding a window pane, said window frame sized to fit in said second opening of said inner frame; said window frame being secured to said inner frame; and (d) releasable engagement means on at least one of said outer frame and said inner frame for releasably engaging said inner frame within said first opening of said outer frame.

2. The window assembly as claimed in claim 1, wherein said outer frame, said inner frame, and said window frame are symmetrical about at least one common axis, thereby allowing installation of said inner frame and said window frame in a plurality of orientations.

3. The window assembly as claimed in claim 2, wherein said outer frame, said inner frame, and said window frame are symmetrical about a horizontal axis.

4. The window assembly as claimed in claim 1, wherein said engagement means comprises a clip located on one of said outer frame and said inner frame and an abutment surface on the other of said inner frame and said outer frame, said inner frame being secured within said first opening when said clip is engaged with said abutment surface.

5. The window assembly as claimed in claim 4, wherein said clip comprises a first connector section for connecting said clip to one of said outer frame and said inner frame, said first connector section having a rear abutment at one end proximal to said interior surface and a dovetail at the opposing end.

6. The window assembly as claimed in claim 4, wherein said clip is located on one of said inner surface of said outer frame and said inner frame and said abutment surface is located on the other of said inner frame and said inner surface of said outer frame.

7. The window assembly as claimed in claim 6, wherein said clip is located on one of said guiding wall and said inner frame and said abutment surface is located on the other of said inner frame and said guiding wall.

8. The window assembly as claimed in claim 5, wherein said clip additionally comprises a second connector section for connecting said clip to said interior surface of said outer frame, and a flange proximal to said second connector section, said flange defining a slot for receiving panelling or drywall.

9. The window assembly as claimed in claim 8, for use in a mobile home or a prefabricated building.

10. The window assembly as claimed in claim 1, wherein said window frame is hinged to said inner frame to allow said window frame to rotate with respect to said inner frame.

11. The window assembly as claimed in claim 10, wherein said window frame is hinged to said inner frame by a pair of hinged window sashes.

12. The window assembly as claimed in claim 11, wherein said window frame and said inner frame are integral.

* * * * *